US006171536B1

(12) United States Patent
Novak et al.

(10) Patent No.: US 6,171,536 B1
(45) Date of Patent: Jan. 9, 2001

(54) APPARATUS AND METHOD FOR MELT SPINNING OF MOLTEN POLYMERIC MATERIAL

(75) Inventors: William O. Novak; J. Richard Goodall, both of Charlotte, NC (US)

(73) Assignee: Arteva North America S.A.R.L.

( * ) Notice: Under 35 U.S.C. 154(b), the term of this patent shall be extended for 0 days.

(21) Appl. No.: 09/058,492

(22) Filed: Apr. 10, 1998

(51) Int. Cl.[7] ..... D01D 1/10

(52) U.S. Cl. ..... 264/169; 210/448; 210/497.01; 210/497.3; 425/198; 425/382.2; 425/464

(58) Field of Search ..... 425/72.2, 198, 425/382.2, 464; 264/176.1, 169; 210/446, 448, 497.01, 497.3

(56) References Cited

U.S. PATENT DOCUMENTS

| | | | | |
|---|---|---|---|---|
| 2,288,532 | | 6/1942 | Knapp . | |
| 2,747,741 | | 5/1956 | Jacobson . | |
| 2,802,574 | | 8/1957 | Schweppe . | |
| 2,865,511 | | 12/1958 | Hopkins, Jr. . | |
| 3,628,930 | * | 12/1971 | Harris | 425/198 |
| 3,794,164 | | 2/1974 | Ginaven . | |
| 3,948,767 | | 4/1976 | Chapman . | |
| 3,948,768 | | 4/1976 | Chapman . | |
| 4,126,560 | | 11/1978 | Marcus et al. . | |
| 4,260,350 | * | 4/1981 | Russell, Jr. | 425/198 |
| 4,341,726 | | 7/1982 | Wilkes . | |
| 4,382,861 | | 5/1983 | Adeboi et al. . | |
| 4,437,986 | | 3/1984 | Hutchins et al. . | |
| 4,512,731 | * | 4/1985 | Cobb | 425/198 |
| 4,655,919 | | 4/1987 | Schafft . | |
| 4,804,510 | * | 2/1989 | Luecke et al. | 425/198 |
| 5,092,999 | | 3/1992 | Valenzuela et al. . | |
| 5,259,955 | | 11/1993 | Bolton . | |
| 5,453,193 | | 9/1995 | Maher et al. . | |

* cited by examiner

*Primary Examiner*—Robert Davis
*Assistant Examiner*—Joseph Leyson
(74) *Attorney, Agent, or Firm*—Gregory N. Clements

(57) ABSTRACT

A method and apparatus for melt spinning molten polymeric material into filaments, preferably embodied in the form of a spin pack assembly, utilizes an annular polymer filter formed of a screen mesh material to have a U-shaped axial cross-section defining an open end oriented to face upwardly for receiving polymer within the annular interior of the screen to flow outwardly therefrom to a downstream spinneret for extrusion. The filter eliminates any need to utilize sand or other filter material contained by the screen as a primary or auxiliary filtration medium and enables effective polymer flow substantially through the entire surface area of the screen without stagnation of material flow.

31 Claims, 5 Drawing Sheets

APPARATUS AND METHOD FOR MELT SPINNING OF MOLTEN POLYMERIC MATERIAL

BACKGROUND OF THE INVENTION

The present invention relates generally to apparatus and method for extrusion of synthetic polymeric material into filaments and, more particularly, to the filtration of polymeric material in molten form during extrusion.

In the conventional manufacturing of synthetic textile yarn, a polymer, such as polyester, is basically prepared in a molten state and extruded under pressure through one or more spinning units, commonly referred to as "spin packs," each equipped with a spinneret formed with multiple fine openings through which the molten polymer is extruded in elongate continuous filamentary form. Typically, the multiple filaments emitted from the spinneret openings are collected into a bundle, forming a tow, which is subsequently collected in a can or like container.

Regardless of the care taken to ensure the purity and homogeneity of the molten polymeric material delivered to the spinning units, the polymer material nevertheless will often include minute gelled particles of the polymer of unusually high molecular weight as well as other solid contaminants. As such if such contaminants are not removed prior to extrusion through the spinneret, the fine orifices in the spinneret can become clogged, and further, any such contaminants passing through the spinneret can produce weakened locations in the resultant filament. Hence, it is common practice to provide a polymer filter medium within each spinning unit to perform a final filtration step immediately in advance of extrusion through the spinneret.

In conventional spinning units, the extrusion orifices are commonly arranged in a circular or otherwise annular array with the body of the spinning unit being formed with a corresponding annular passageway opening into direct communication with the spinneret orifices. An annular screen is fitted within the downstream end of the passageway to extend upstream into the passageway with the portion of the passage on the upstream side of the screen being filled with sand or a similar filtering material. Thus, the molten polymer entering the annular passageway must follow a torturous path through and about the sand or other filter material to reach the screen at which the polymer flows inwardly through the screen and therefrom to the spinneret. The screen thereby serves not only to assist in filtration of the polymer but also to prevent the filter material from flowing with the polymer into the orifices of the spinneret.

While such polymer filtration arrangements function satisfactorily to substantially remove most contaminants from the molten polymer, the use of sand or a similar filter material as a filtration medium complicates the fabrication of the spin packs as well the periodic cleaning and maintenance thereof. Further, the screens typically used to retain the filter material in place separated from the spinnerets are typically fabricated of two circular pieces of screen affixed along annular abutting edges by an impervious binder clip, which produces the additional disadvantage of creating a stagnant area of polymer in the area surrounding the binder clip. The rate and efficiency of polymer throughput is accordingly affected.

SUMMARY OF THE INVENTION

It is accordingly an object of the present invention to provide an improved means and methodology of filtering molten polymer in melt spinning of filaments. A more particular object of the present invention is to provide an improved filtering means and method in which the use of loose filter material as a filtering medium can be eliminated. A further object of the invention is to provide an improved filter screen configuration for use in spin packs for melt spinning, which will provide increased filter area in comparison to conventional filter screens of the type described above.

Briefly summarized, the foregoing objectives are provided in the present invention by a novel apparatus and method for melt spinning of molten polymeric material into filaments utilizing a filter having a substantially continuous screen wall of a generally U-shaped configuration which defines an open end, a merged end and an interior material receiving area. The polymeric material is conveyed by suitable means through the open end and into the interior area of the filter and outwardly therefrom through the screen wall, for delivery of the filtered polymeric material to, and for extrusion through, plural openings in a downstream spinneret communicating with the filter.

In a preferred embodiment, the apparatus and method are embodied in a spin pack assembly having a pack body defining an essentially vertical annular passageway for flow of polymeric material downwardly therethrough. The screen wall of the filter is annular with a generally U-shaped axial cross-section, the filter being disposed in essentially vertical disposition within the annular passageway with the open end facing upwardly and the merged end facing downwardly, for receiving the polymeric material through the open upper end and into the interior material receiving area of the filter. The spinneret is affixed directly to the pack body with its multiple filament extrusion openings in an annular arrangement for communicating directly with the annular passageway to receive the filtered polymeric material.

DESCRIPTION OF THE PREFERRED EMBODIMENT

Figure 1:
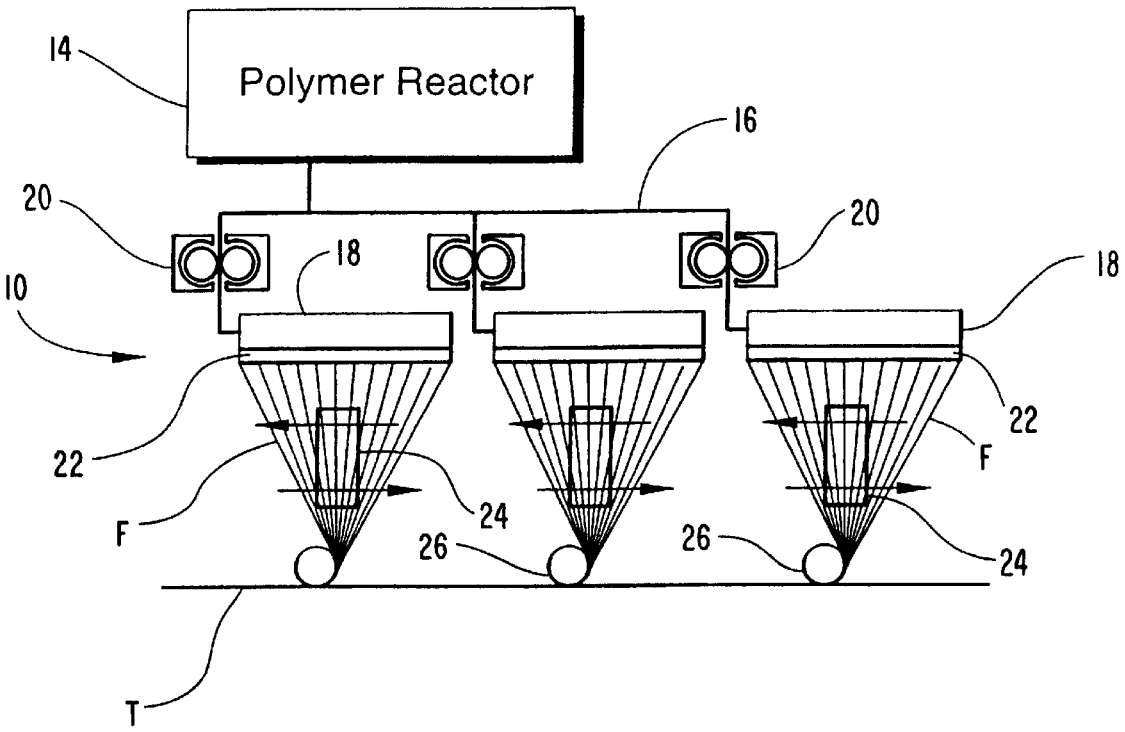
FIG. 1 is a schematic diagram illustrating a system for extruding and bundling continuous textile filaments into a tow, in which the melt spinning apparatus and method of the present invention may be preferably embodied.
Figure 2:
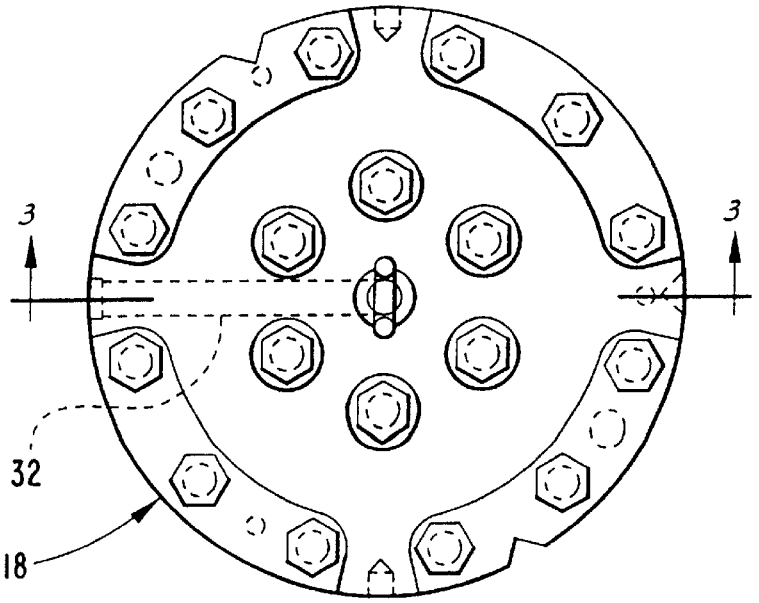
FIG. 2 is a top plan view of one of the spin pack assemblies of the present invention from the extrusion system of FIG. 1.

Referring now to the accompanying drawings and initially to FIG. 1, a production line for extruding multiple elongate continuous synthetic textile filaments in which the apparatus and method of the present invention may be preferably embodied is generally indicated at 10. The production line basically comprises a polymer reactor, indicated only schematically at 14, by which a molten polymer, such as polyester, is prepared and delivered through a system of feed conduits 16 to a plurality of spinning units 18, commonly referred to as "spin packs," through a corresponding plurality of gear pumps 20 which serve to provide a uniformly metered flow of the molten polymer into the respective spin packs 18. For sake of simplicity, only three such spin packs 18 are depicted in FIG. 1, but it will be recognized and understood by persons skilled in the art that, in practice, substantially larger numbers of spin packs, e.g., commonly between 16 and 24 units, may typically be provided. Each spin pack 18 includes a spinneret, indicated at 22, through which the molten polymer delivered under pressure from the associated gear pump 20 is extruded in elongate continuous filamentary form, as indicated by the filaments F.

The multiple filaments F from each spin pack 18 are withdrawn downwardly along mutually converging paths moving past a quenching unit, indicating schematically at 24, to cool the filaments F sufficiently at least to reduce their temperature below the glass transition temperature of the polymer. The respective filaments F from the spin pack are collected and diverted horizontally about respective deflection rolls 26 to bundle the filaments in coextensive side-by-side parallel relation into the form of a tow, indicated at T. The bundled filaments and the tow T travel collectively to a downstream location (not shown) for further processing, such as by a compaction jet device to promote cohesiveness of the constituent filaments, and therefrom to a collection station for placement of the tow T into suitable cans or other containers.

As thus far illustrated and described, the basic apparatus and process methodology for extruding the filaments F is conventional and well known. In accordance with the present invention, each spin pack assembly 18 is equipped with an improved means and process capability for filtering the molten polymeric material in advance of extrusion through its respective spinneret 22, as may best be seen and understood with reference to FIGS. 2–5. Basically, each spin pack assembly 18 comprises a main circular pack body 28 sealably closed at its upper and lower sides by a circular pack lid 30 bolted to the upper axial side of the pack body 28 and by the spinneret 22, which is of a corresponding circular configuration and dimension, similarly bolted to the main pack body 28 at its lower axial side.

The pack lid 30 is formed with a bore 32 extending from the outer circumferential periphery of the lid 30 radially to its axial center, whereat the bore 32 turns approximately 90° downwardly into communication with an annular conical passageway 34 opening in the form of a circular slot 34' at the bottom face of the lid 30. The main pack body 28 is formed with a circular passageway 36 extending axially through the body 28 from the upper face to the lower face thereof, the upper end of the passageway 36 mating with the slotted circular opening 34' in the bottom face of the pack lid 30. The passageway 36 has an upper section 36' tapering inwardly from the upper axial side of the main pack body 28 and merging at the lower end of the section 36' with a straight passageway section 36" extending to an opening at the bottom face of the main pack body 28. The spinneret 22 has an annular area 38 concentric to its axis, formed with a plurality of closely-spaced axial orifices 40 mating precisely with the downwardly facing circular opening from the passageway 36 in the bottom face of the main pack body 28.

Figure 5:
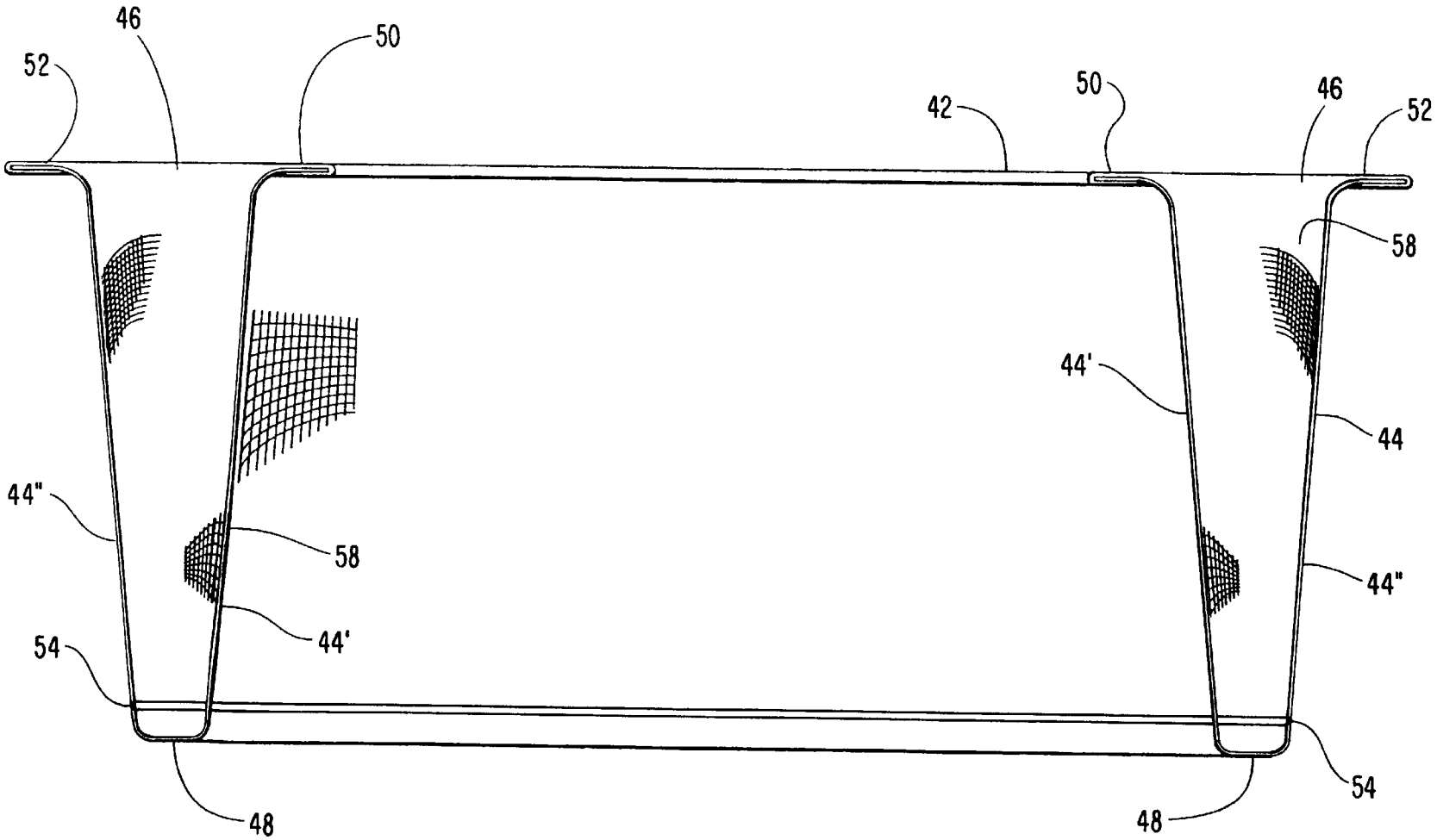
FIG. 5 is a vertical cross-sectional view of the improved polymer filter in accordance with the present invention, shown disassembled from the spin pack assembly of FIGS. 2–4.

An annular filter 42, shown separately in FIG. 5, is supported by the main pack body 28 within the upper tapered section 36' of the passageway 36. As best seen in FIG. 5, the filter 42 is formed of a fine-mesh screen material fabricated into a continuous annular screen wall of a generally U-shaped axial cross-section. The screen wall 44 is preferably fabricated of a circular inner screen section 44' and a circular outer section 44" spaced from one another at the upper end of the filter 42 to define an upper filter opening 46 and taperingly converging to merge with one another at the lower end of the filter 42 to define the U-shaped axial cross section of the screen wall 44, the inner screen section 44' being bent at its lower end outwardly and upwardly to form the closed lower end 48 of the filter 42 and to merge in edgewise abutment with the lower end of the outer screen section 44" whereat the inner and outer screen sections 44', 44" are seam-welded to one another. The upper annular margins of the inner and outer screen sections 44', 44" are bent oppositely to one another to extend outwardly from the upper filter opening 46, thereby defining inner and outer edge margins 50, 52 by which the filter 42 is supported at the upper face of the main pack body 28 within annular recesses bordering the inner and outer edges of the passageway 36.

Figure 3:
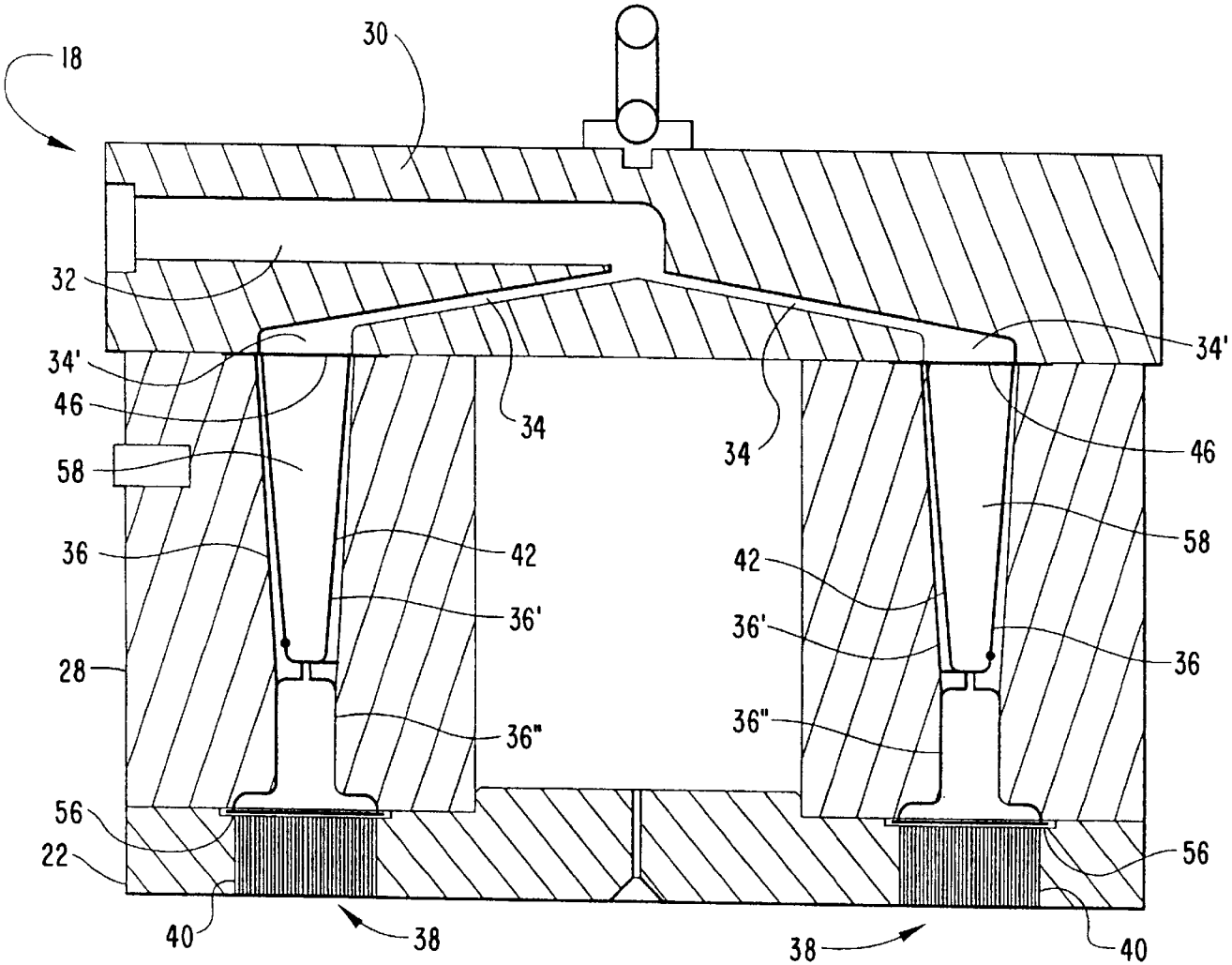
FIG. 3 is a vertical cross-sectional view taken through the spin pack assembly of FIG. 2 along line 3—3 thereof.
Figure 4:
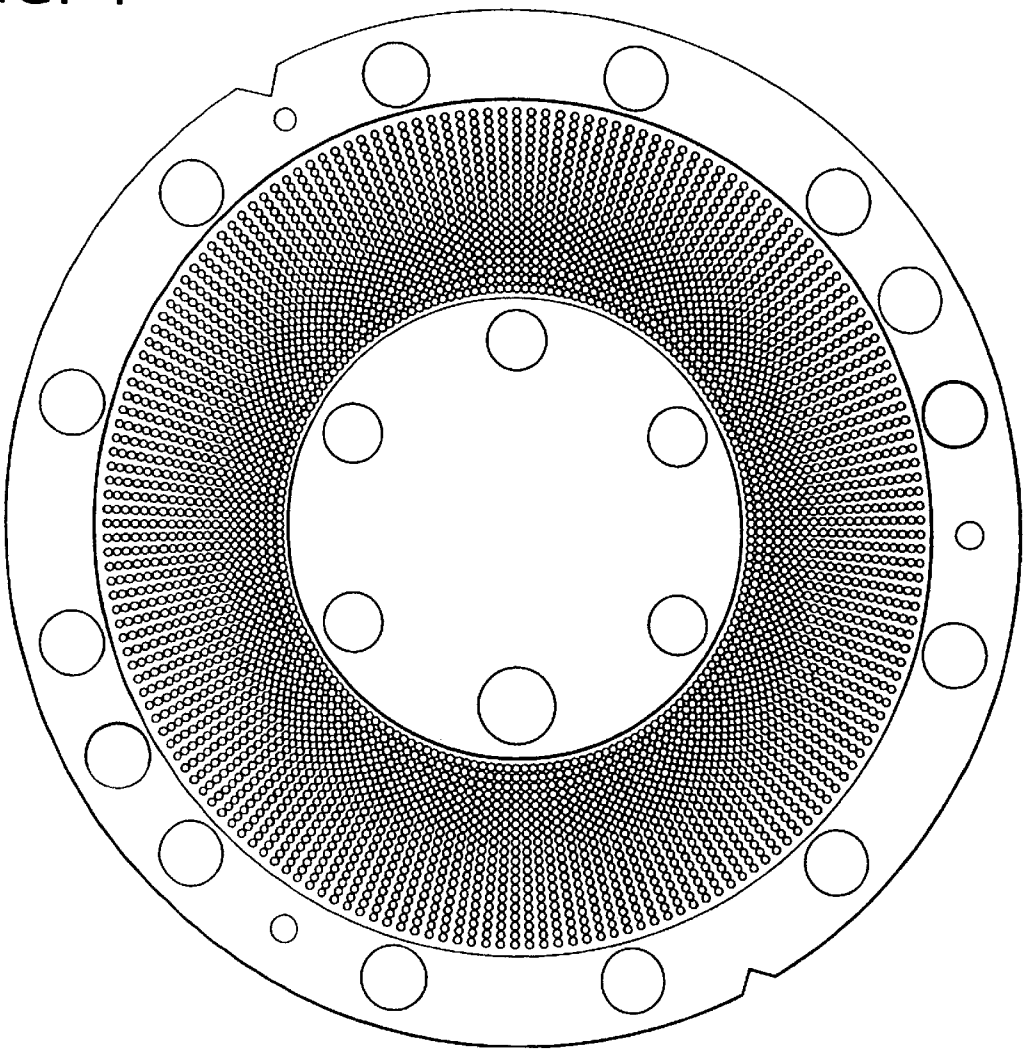
FIG. 4 is a bottom plan view of the spin pack assembly of FIGS. 2 and 3.

As best seen in FIG. 3, the filter 42, as thusly supported by the main pack body 28 within the annular passageway 36, has a U-shaped axial cross-section generally corresponding to the tapered configuration of the upper section 36' of the passageway 36, but the radial dimension of the filter 42 is sufficiently reduced in relation to the radial dimension of the passageway section 36' to space the screen wall 44 uniformly from both the inner and outer walls of the passageway 36 defining its tapered section 36'.

The screen wall 44 of the annular screen 42 may be fabricated of any suitable material sufficiently strong to maintain its shape and resist distortion under the forces of pressurized polymer flow through the spin pack assembly 18 and sufficiently inert with respect to the polymeric material being extruded there-through so as to resist corrosion and deterioration. One such material which is to be found to be suitable is stainless steel wire cloth woven to define sufficiently constricted interstices in the wire cloth relative to the molecular size and weight of the polymeric material to be filtered so as to perform a satisfactory filtration function. For example, stainless steel cloth formed of wire of a diameter in the range of 0.006 to 0.015 inches woven to a mesh size defining interstices in the range of 25 to 60 microns are anticipated to function satisfactorily for such purposes. However, those persons skilled in the art will readily recognize, that screen filters formed of other suitable materials of differing wires and mesh dimension may also function satisfactorily according to the particular extrusion application.

The upper face of the spinneret 22 is formed with a circular recess at the annular area 38, to receive a flat annular screen 56 facing directly the downward opening of the passageway 36 at the bottom face of the main pack body 28, for purposes of supplementary filtration of the polymeric material.

The operation of the spin pack assembly 18 of the present invention may thus be understood. While the filter 42 could be utilized to contain sand or a similar filtration medium within the interior area 58 defined by the screen wall 44, the present invention contemplates that, in most preferred embodiments and applications of the filter 42, the filter alone, without any auxiliary filter elements or media, will be utilized in the spin pack assembly 18. In ongoing operation, molten polymer from the reactor 14 is metered under pressure into each spin pack assembly 18 through the radial bore 32 in its lid 30 and is distributed therefrom via from the passageway 34 annularly about the passageway 36 to fully occupy the interior area 58 defined by the screen wall 44 of the filter 42.

Figure 6A:
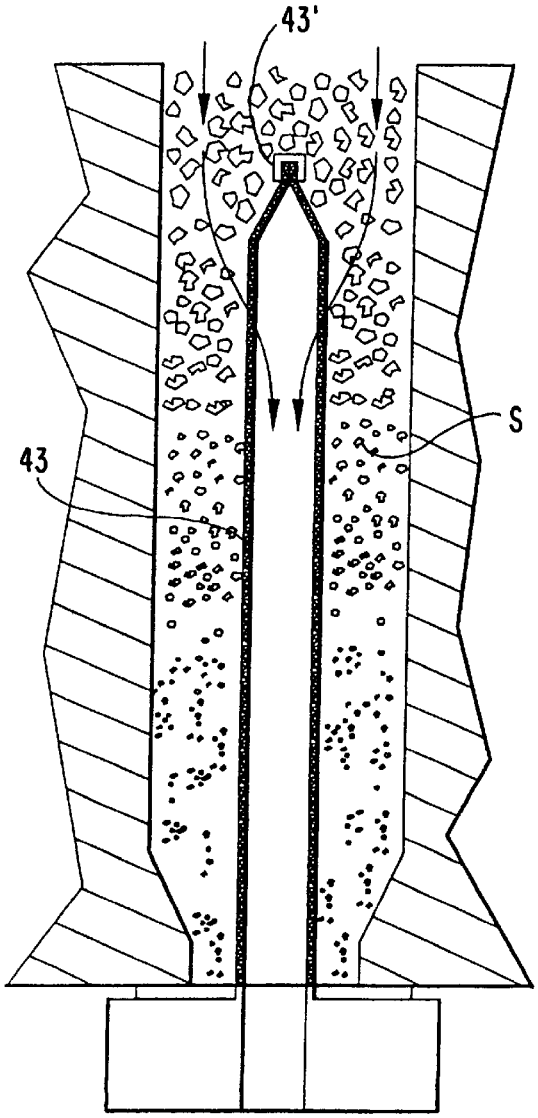
FIG. 6A PRIOR ART
FIGS. 6A and 6B schematically depict comparatively a prior art polymer filter system as used in conventional melt spinning (FIG. 6A) and the melt spinning polymer filter in accordance with the present invention (FIG. 6B).
Figure 6B:
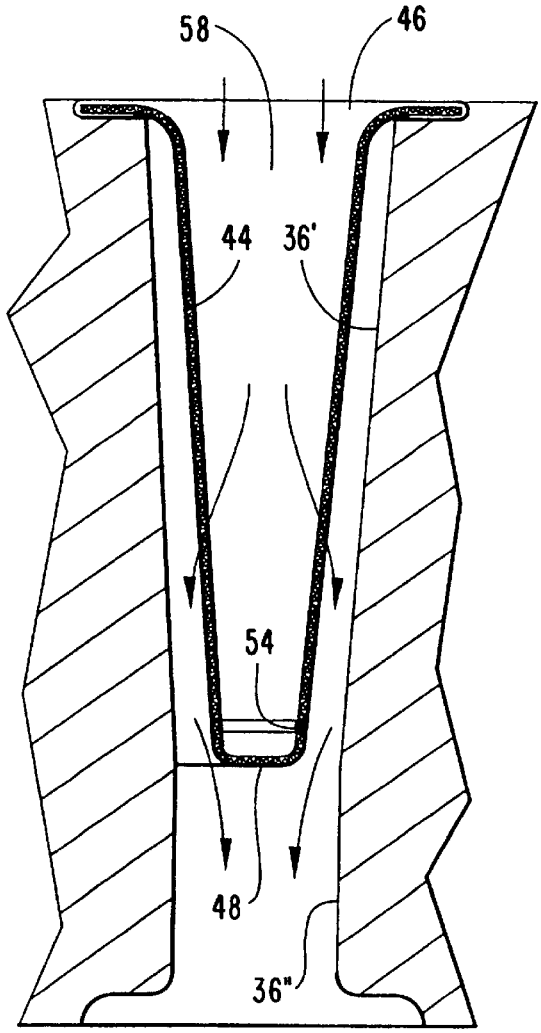

As already indicated above, by the appropriate selection of the screen material for the filter 42 and the mesh size of the interstices defined thereby, the screen wall 44 performs an effective filtration of gels and other solid contaminants from the polymer without requiring the assistance of additional filter material. In contrast to conventional screens 43 used as a support for sand S or other filter media, wherein the binder clip 43' conventionally utilized blocks polymer flow and creates an area of stagnant polymer as depicted schematically in FIG. 6A, the U-shape of the screen wall 44 together particularly with the edgewise seam-welding of its inner and outer screen sections 44', 44" substantially eliminates any stagnation in the polymer flow and, moreover, provides a substantially increased surface area to the filter screen which enables enhanced polymer throughput rates to be achieved without compromising filter efficiency, as comparatively depicted schematically in FIG. 6B. It is to be understood, as persons skilled in the relevant art will understand, that the term "U-shaped" as used herein to describe the configuration of the screen wall is intended to mean and to encompass essentially any screen wall whose cross-sectional configuration is generally in the shape of a U or V, including screen walls of parabolic shape, bow shape, or other curved shapes as well as screened walls having bend lines as in the illustrated embodiment. By elimination of the need to use sand or other filter media within the spin pack assembly 18, the fabrication of the spin pack 18 as well as the periodic cleaning and maintenance thereof is substantially simplified over conventional spin pack assemblies. Even though the seam weld 54 formed between the inner and outer screen sections 44', 44" partially blinds the screen 44 along the seam, the location of the seam weld along the vertical extent of the outer screen section 44" minimizes any interruption in the natural flow of the polymer through the screen 44 to avoid any stagnation in polymer flow or other deleterious effect.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for melt spinning of molten polymeric material into filaments, comprising a filter having an annular screen wall which is generally U-shaped in axial cross section defining an open end, a merged end and an interior material receiving area, means for conveying the polymeric material through the open end and into the interior material receiving area of the filter and outwardly therefrom through the screen wall for filtration of the polymeric material, and a spinneret defining a plurality of filament extrusion openings communicating with the filter for receiving and extruding the filtered polymeric material into filaments.

2. Apparatus for melt spinning of molten polymeric material according to claim 1, wherein the screen wall is disposed in an essentially vertical disposition with the open end facing upwardly and the merged end facing downwardly.

3. Apparatus for melt spinning of molten polymeric material according to claim 1, wherein the conveying means comprises means defining a polymeric material flow passageway supporting the filter therein.

4. Apparatus according to claim 3, wherein the passageway is devoid of any other filtration medium.

5. Apparatus for melt spinning of molten polymeric material according to claim 1, wherein the conveying means comprises a body defining an annular polymeric material flow passageway supporting the annular screen wall therein.

6. Apparatus for melt spinning of molten polymeric material according to claim 5, wherein the passageway is devoid of any other filtration medium.

7. A spin pack assembly for melt spinning of molten polymeric material into filaments, comprising a pack body defining an essentially vertical annular passageway for flow of polymeric material downwardly therethrough, a spinneret affixed to the pack body and defining a plurality of filament extrusion openings in an annular arrangement communicating with the passageway for receiving and extruding the polymeric material into filaments, and a filter comprising an annular screen wall of a generally U-shaped configuration in axial cross-section defining an annular open end, an annular merged end and an annular interior material receiving area, the filter being disposed in an essentially vertical disposition within the annular passageway with the open end facing upwardly and the merged end facing downwardly for receiving the polymeric material through the open upper end and into the interior material receiving area of the filter and for flow of the polymeric material outwardly therefrom through the screen wall for delivery of the filtered polymeric material to the spinneret.

8. A process for melt spinning of molten polymeric material into filaments, comprising the steps of filtering a polymeric material in advance of extruding the polymeric material through a plurality of filament extrusion openings in a spinneret, the filtering comprising providing a filter having an annular screen wall which is generally U-shaped in axial cross section defining an open end, a merged end and an interior material receiving area, and conveying the polymeric material through the open end and into the interior material receiving area of the filter and outwardly therefrom through the screen wall.

9. A process for melt spinning of molten polymeric material according to claim 8, and further comprising orienting the filter with the screen wall in an essentially vertical disposition with the open end facing upwardly and the merged end facing downwardly for flow of the polymeric material downwardly into the interior material receiving recess.

10. A process for melt spinning of molten polymeric material according to claim 9, and further comprising utilizing the screen wall as the only medium for filtering the polymeric material.

11. Apparatus according to claim 6, wherein the screen wall is disposed in an essentially vertical disposition with the open end facing upwardly and the merged end facing downwardly.

12. A spin pack assembly according to claim 7, wherein the annular passageway is devoid of any other filtration medium.

13. Apparatus according to claim 5, wherein the screen wall is disposed in an essentially vertical disposition with the open end facing upwardly and the merged end facing downwardly.

14. Apparatus according to claim 13, wherein the body defining the annular polymeric material flow passageway is a pack body having an upper axial side and a lower axial side and wherein said passageway extends axially through said pack body and has an upper section which tapers inwardly from the upper axial side and which merges at its lower end with a straight passageway section.

15. Apparatus according to claim 14 wherein the radial dimension of the filter is sufficiently reduced in relation to the radial dimension of the tapered upper section of the passageway to space the screen wall uniformly from both the inner and outer walls of said tapered upper section.

16. Apparatus according to claim 15, wherein the screen wall comprises a circular inner screen section and a circular outer screen section spaced from one another at the upper end of the filter to define an upper filter opening and taperingly converging to merge with one another at the lower end of the filter to define the U-shaped axial cross section of said screen wall.

17. Apparatus according to claim 16 wherein the inner screen section is bent at its lower end outwardly and upwardly to form a closed lower end of the filter and to merge in edgewise seam welded abutment with the lower vertical extent of the outer screen section.

18. Apparatus according to claim 17 wherein the upper annular margins of the inner and outer screen sections are bent oppositely to one another to extend outwardly from the upper filter opening, thereby defining inner and outer edge margins by which the filter is supported.

19. Apparatus according to claim 18 wherein the annular polymeric material flow passageway is devoid of any other filtration medium.

20. Apparatus according to claim 16 wherein the upper annular margins of the inner and outer screen sections are bent oppositely to one another to extend outwardly from the upper filter opening, thereby defining inner and outer edge margins by which the filter is supported.

21. Apparatus according to claim 20 wherein the annular polymeric material flow passageway is devoid of any other filtration medium.

22. A spin pack assembly according to claim 7, wherein the pack body has an upper axial side and a lower axial side and wherein the vertical annular passageway extends axially through said pack body and has an upper section which tapers inwardly from the upper axial side of the pack body.

23. A spin pack assembly according to claim 22 wherein the radial dimension of the filter is sufficiently reduced in relation to the radial dimension of the tapered upper section of the passageway to space the screen wall uniformly from both the inner and outer walls of said tapered upper section.

24. A spin pack assembly according to claim 23, wherein the screen wall comprises a circular inner screen section and a circular outer screen section spaced from one another at the upper end of the filter to define an upper filter opening and taperingly converging to merge with one another at the lower end of the filter to define the U-shaped axial cross section of said screen wall.

25. A spin pack assembly according to claim 24 wherein the screen wall has a mesh size defining interstices in the range of 25 to 60 microns.

26. A spin pack assembly according to claim 7 wherein the screen wall has a mesh size defining interstices in the range of 25 to 60 microns.

27. Apparatus according to claim 2 wherein the screen wall has a mesh size defining interstices in the range of 25 to 60 microns.

28. Apparatus according to claim 1 wherein the screen wall has a mesh size defining interstices in the range of 25 to 60 microns.

29. A process according to claim 10 wherein the screen wall has a mesh size defining interstices in the range of 25 to 60 microns.

30. A process according to claim 9 wherein the screen wall has a mesh size defining interstices in the range of 25 to 60 microns.

31. Apparatus according to claim 2 wherein the screen wall is fabricated of a circular inner screen section and a circular outer screen section spaced from one another at the upper end of the filter to define an upper filter opening and taperingly converging to merge with one another at the lower end of the filter to define the U-shaped axial cross section of the screen wall, said inner screen section being bent outwardly and upwardly to form a closed lower end of the filter and to merge in edgewise abutment with the lower end of said outer screen section whereat the inner and outer screen sections are seam welded to one another.

* * * * *